US006244742B1

(12) United States Patent
Yamada et al.

(10) Patent No.: US 6,244,742 B1
(45) Date of Patent: Jun. 12, 2001

(54) SELF-WINDING ELECTRIC POWER GENERATION WATCH WITH ADDITIONAL FUNCTION

(75) Inventors: Shinichi Yamada; Kenji Miyasaka; Takayuki Hasumi, all of Tanashi; Kazuhide Kinoshita, Iida, all of (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/447,805

(22) Filed: Nov. 23, 1999

Related U.S. Application Data

(63) Continuation of application No. PCT/JP99/01820, filed on Apr. 6, 1999.

(30) Foreign Application Priority Data

Apr. 8, 1998 (JP) ..... 10-095576
Apr. 16, 1998 (JP) ..... 10-106249

(51) Int. Cl.[7] ..... G04B 25/02
(52) U.S. Cl. ..... 368/148
(58) Field of Search ..... 368/148–154

(56) References Cited

FOREIGN PATENT DOCUMENTS 59-122992 7/1984 (JP) .
63-265188 11/1988 (JP) .
63-200188 12/1988 (JP) .
64-10692 1/1989 (JP) .
4-142491 5/1992 (JP) .
5-323051 12/1993 (JP) .

*Primary Examiner*—Bernard Roskoski
(74) *Attorney, Agent, or Firm*—Kanesaka & Takeuchi

(57) ABSTRACT

A self-winding electric power generation watch capable of having an additional function structure besides a time indication and an electric power generation function by virtue of an efficient arrangement of train wheels and motors for watch, electric power generation, and additional function in a watch case. An electric power generation motor 12 for conducting self-winding electric power generation by means of rotation of a rotary weight 41*a*, a watch motor 11 driven by electric power of the electric power generation motor 12, a storage battery 14 for storing the electric power of the electric power generation motor 12, and a chronograph motor 13 driven by the electric power of the electric power generation motor 12 are arranged in a watch case so as to surround a center part of the watch. Watch train wheels 20 and 30, an electric power generation train wheel 40, and a chronograph train wheel 50 are disposed in a two-layer form in a region surrounded by the motors.

18 Claims, 12 Drawing Sheets

SELF-WINDING ELECTRIC POWER GENERATION WATCH WITH ADDITIONAL FUNCTION

CROSS REFERENCE TO RELATED APPLICATION

This is a continuation application of PCT International Application of PCT/JP99/01820 filed on Apr. 6, 1999.

TECHNICAL FIELD

The present invention relates to an electronic watch of self-winding electric power generation type having a self-winding electric power generation function utilizing a rotary weight. In particular, the present invention relates to a self-winding electric power generation watch which is capable of having an additional function structure besides the ordinary time indication function and the self-winding electric power generation function by efficiently disposing train wheels for watch, electric power generation, and additional function, and motors for driving these train wheels within a watch case, which is prevented from becoming large in size of the entire watch though both the self-winding electric power generation function and the additional function are provided, and which mainly has a chronograph as the additional function.

BACKGROUND ART

In recent years, there have been developed electronic wrist watches of self-winding electric power generation type mounted with a self-winding electric power generation device for converting the mechanical energy of the rotary weight to electrical energy.

An electric power generation watch having a self-winding electric power generation device heretofore proposed has, in the watch case, a time indication train wheel including a third wheel, a fourth wheel, a fifth wheel and so on, a time correction train wheel including minute wheel and so on, a speed increasing train wheel for electric power generation including an electric power generation intermediate wheel, and motors for driving these train wheels. And these train wheels and motors are disposed in the watch case so as not to overlap each other.

Furthermore, the motor for electric power generation disposed in the case is formed so as to become slender in order to improve the electric power generation efficiency of the electric power generation device. This slender motor for electric power generation is mounted on a ground plate in such a position as not to interfere with the above described train wheels and other motors.

Heretofore, such electric power generation watches having an electric power generation function have been proposed in Japanese Patent Application Laid-Open No. HEI-7-333360 and Japanese Patent Application Laid-Open No. HEI-5-323051.

Incidentally, such electronic wrist watches of self-winding electric power generation type are rapidly spreading in recent years. With the spread of the self-winding electric power generation watches, there are demanded electric power generation watches of multi-function type having an additional function, such as a chronograph function, other than the ordinary time indication function, besides the self-winding electric power generation function.

Here, in the multi-function wrist watch having an additional function such as a chronograph function, besides components which is used for time indication of the ordinary wrist watch which has no electric power generation function, components which are used for an additional function, such as a train wheel for chronograph, are mounted on the watch case of such a multi-function wrist watch.

In the conventional electric power generation watch having a self -winding electric power generation device, however, train wheels for time indication, time correction, and electric power generation, and a plurality of motors for driving these train wheels are disposed in the watch case with no space as described above. Within this case, there is no space for disposing a multi-hand structure for the chronograph or the like and other components of the multi-function structure.

In other words, in the conventional self-winding electric power generation watch, the train wheels and motors performing the original function of the electric power generation watch, such as the time indication function and the electric power generation function, are disposed so as to occupy the entire space on the ground plate ranging from the center portion of the watch to the peripheral portion. Therefore, it is difficult to add the additional function structure thereto from the viewpoint of the two-dimensional space. Furthermore, if it is attempted to mount the additional function structure above or under the train wheels and motors, it becomes impossible to support the train wheel for electric power generation and the train wheel for the additional function within the case via shafts.

In the conventional self-winding electric power generation watch, therefore, it is difficult to mount the additional function structure such as the chronograph structure from the aspect of space so long as a large sized ground plate and a large sized case exceeding a range permitted as a wrist watch are not provided. Until now, production of a self-winding electric power generation watch having the additional function has not been realized.

An object of the present invention is to provide a self-winding electric power generation watch having an additional function structure which is free from the above described drawbacks of the conventional self-winding electric power generation watch, which is prevented from becoming large in size of the entire watch by efficiently disposing the train wheels for watch, electric power generation, and additional function, and motors for driving these wheels in a watch case, and which is capable of having a further additional function in the self-winding electric power generation watch.

DISCLOSURE OF INVENTION

In accordance with the present invention, a self-winding electric power generation watch with additional function includes: an electric power generation motor for self-winding electric power generation for generating electric power by using a rotation movement of a rotary weight, and an electric power generation train wheel for transmitting the rotation movement of the rotary weight to the electric power generation motor; a watch motor and a watch train wheel for time indication driven by the electric power of the electric power generation motor; and a storage battery for storing the electric power of the electric power generation motor. The self-winding electric power generation watch includes an additional function motor and an additional function train wheel driven by the electric power of the electric power generation motor to conduct indication other than time indication. The electric power generation motor, the watch motor, the additional function motor, and the storage battery are disposed in a watch case so as to surround a watch center part. In addition, the electric power generation train wheel, the watch train wheel, and the additional function train wheel are disposed in a region surrounded by the electric power generation motor, the watch motor, the additional function motor, and the storage battery.

Furthermore, in accordance with the present invention, the watch includes a ground plate disposed in a watch case, a platelike intermediate cradle disposed so as to be opposed to the ground plate, and a platelike additional function cradle disposed in the opposition side of said intermediate cradle from said ground plate.

Shafts of the watch train wheel are supported by the ground plate and the intermediate cradle, and the additional function train wheel is supported by the intermediate cradle and the additional function cradle via shafts.

As a result, a plurality of motors performing functions can be disposed in the watch case so as to be opposed to each other and separated from each other. A bad influence caused by proximity between motors can thus be prevented. By utilizing the arrangement configuration of the motors, an efficient arrangement of other components, such as a storage battery, hand setting components, and the train wheels, becomes possible. In addition, the sectional positions of the motors can be set to nearly the same height. Therefore, it becomes possible to make the watch structure thin.

Furthermore, in a region surrounded by the motors, the ground plate disposed on the bottom of the case, and the platelike intermediate cradle and the platelike chronograph cradle opposed to the ground plate are provided. Shafts of a plurality of train wheels performing functions can be supported in a two-layer structure by the ground plate, the intermediate cradle, and the chronograph cradle. For example, by disposing a time indication train wheel and a time correction train wheel, and an electric power generation speed increasing train and an additional function train wheel in two stages, therefore, the train wheels can be arranged efficiently in the periphery of the center part of the watch surrounded by the motors, without two-dimensional restriction between train wheels. Size reduction of the watch movement can thus be realized.

In this way, according to the present invention, the train wheels for watch, electric power generation, and chronograph function, and the motors for driving these train wheels can be disposed efficiently within the watch case. It thus becomes possible to provide the self-winding electric power generation watch with an additional function other than the time indication function without increasing the size of the watch as a whole. In addition, it becomes possible to make the watch thin though the watch has the additional function.

BEST MODE FOR CARRYING OUT THE INVENTION

Hereafter, the present invention will be described in more detail by referring to accompanying drawings.

Figure 1:
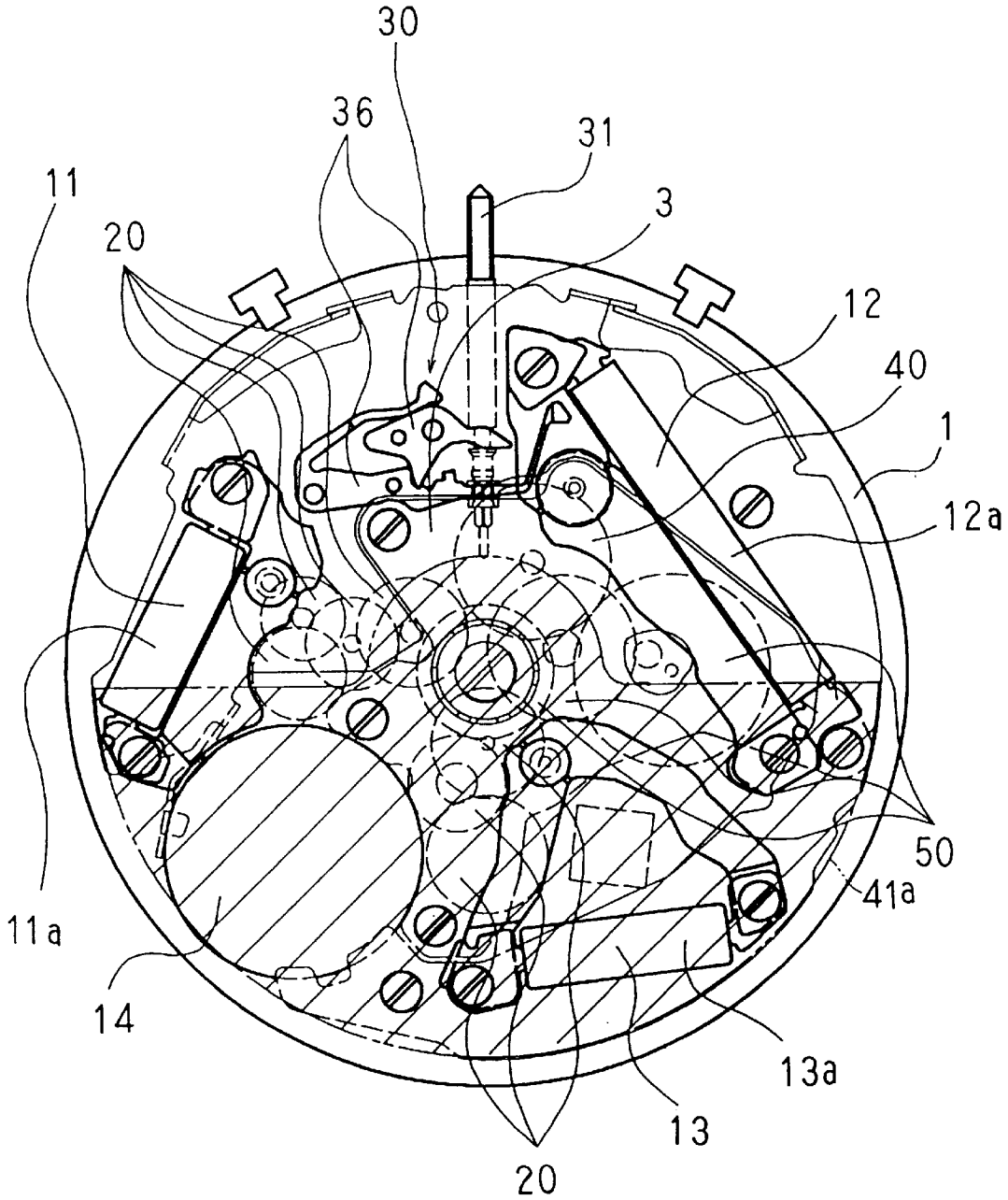
FIG. 1 is a schematic overall plan view schematically showing a preferred embodiment of a self-winding electric power generation watch with an additional function according to the present invention when viewed from the watch bottom side.
Figure 2:
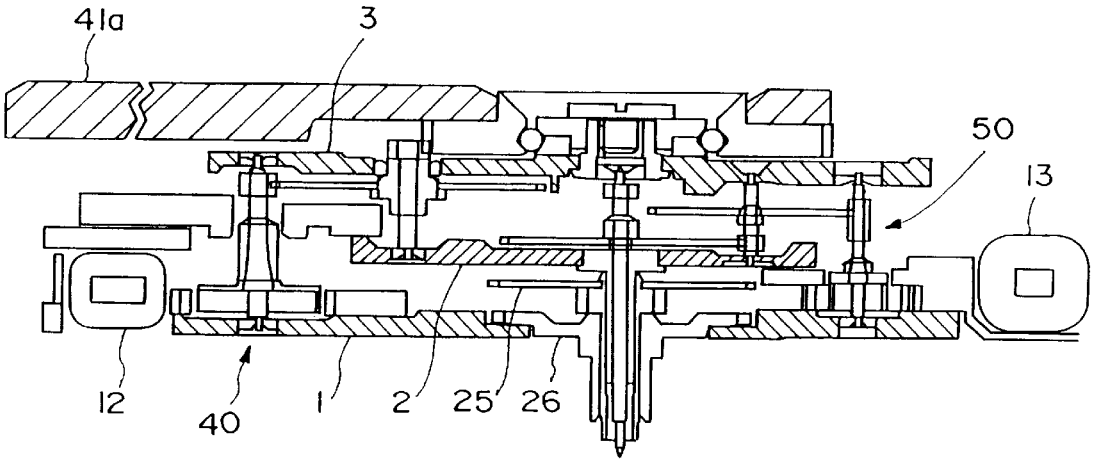
FIGS. 2(*a*) and 2(*b*) are longitudinal sectional view of a principal part of the electric power generation watch of the present invention shown in FIG. 1, wherein FIG. 2(*a*) is a sectional view of a portion including a motor for electric power generation and a motor for additional function, and FIG. 2(*b*) is a sectional view of a portion including the motor for electric power generation and a motor for watch.
Figure 2:
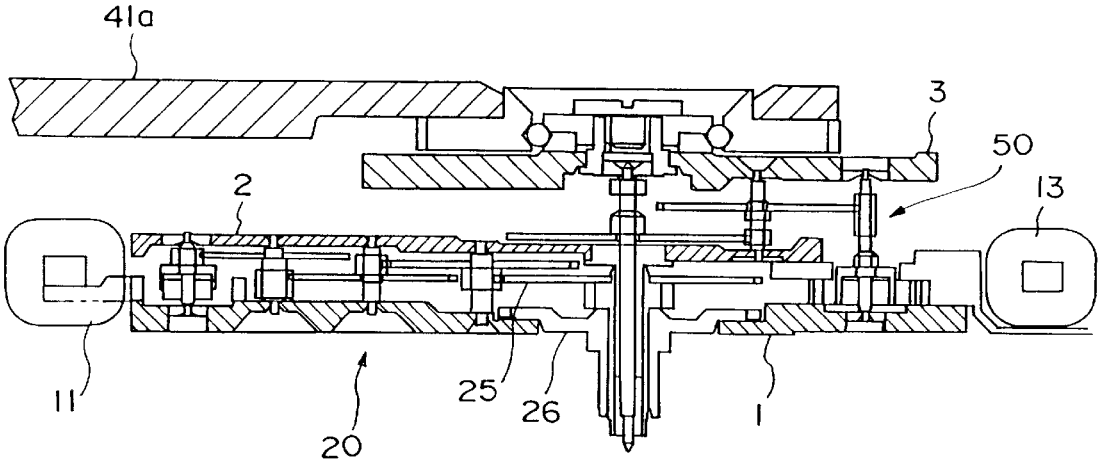

FIG. 1 is a schematic overall view schematically showing a preferred embodiment of a self-winding electric power generation watch with an additional function according to the present invention when viewed from the watch bottom side. FIGS. 2(*a*) and 2(*b*) are longitudinal sectional views of a principal part of this electric power generation watch.

An embodiment of the present invention shown in FIGS. 1, 2(*a*) and 2(*b*) is an electronic wrist watch of self-winding electric power generation type including an electric power generation motor 12 for self-winding electric power generation which generates electric power according to a rotary motion of a rotary weight 41*a*, a train wheel 40 for electric power generation (a speed increasing train wheel for electric power generation) for transmitting the rotary motion of the rotary weight to the electric power generation motor 12, and a storage battery 14 for storing electric power of the electric power generation motor 12. The electronic wrist watch in the present embodiment includes a motor 11 for watch and train wheels for watch (a time indication train wheel 20 and a time correction train wheel 30) for performing the ordinary time indication function by electric power supplied from the electric power generation motor 12 (storage battery 14).

In addition, the present embodiment includes a motor 13 for chronograph and a train wheel 50 for chronograph, as a structure of an additional function for conducting indication other than the time indication. Components including these motors and train wheels are efficiently disposed and mounted in a watch case (not illustrated).

To be concrete, first of all, the electric power generation motor 12, the motor 11 for watch, the storage battery 14, and the motor 13 for chronograph are disposed along a periphery of a ground plate 1 in the watch case so as to surround a central part of the watch as shown in FIGS. 1, 2(*a*) and 2(*b*).

And on the ground plate 1 in a region surrounded by these motors and the storage battery 14, the train wheel 40 for electric power generation, the train wheels 20 and 30 for watch, and the train wheel 50 for chronograph are disposed.

Furthermore, in the watch case into which these components are incorporated, the ground plate 1 disposed on the bottom of the case, a platelike intermediate cradle 2 disposed so as to be opposed to the ground plate 1, and a platelike additional function cradle (chronograph cradle 3) disposed in the opposition side of said intermediate cradle from said ground plate 1 are provided. Shafts of respective train wheels are supported in a two-layer structure by the ground plate 1, the intermediate cradle 2, and the chronograph cradle 3.

Figure 7:
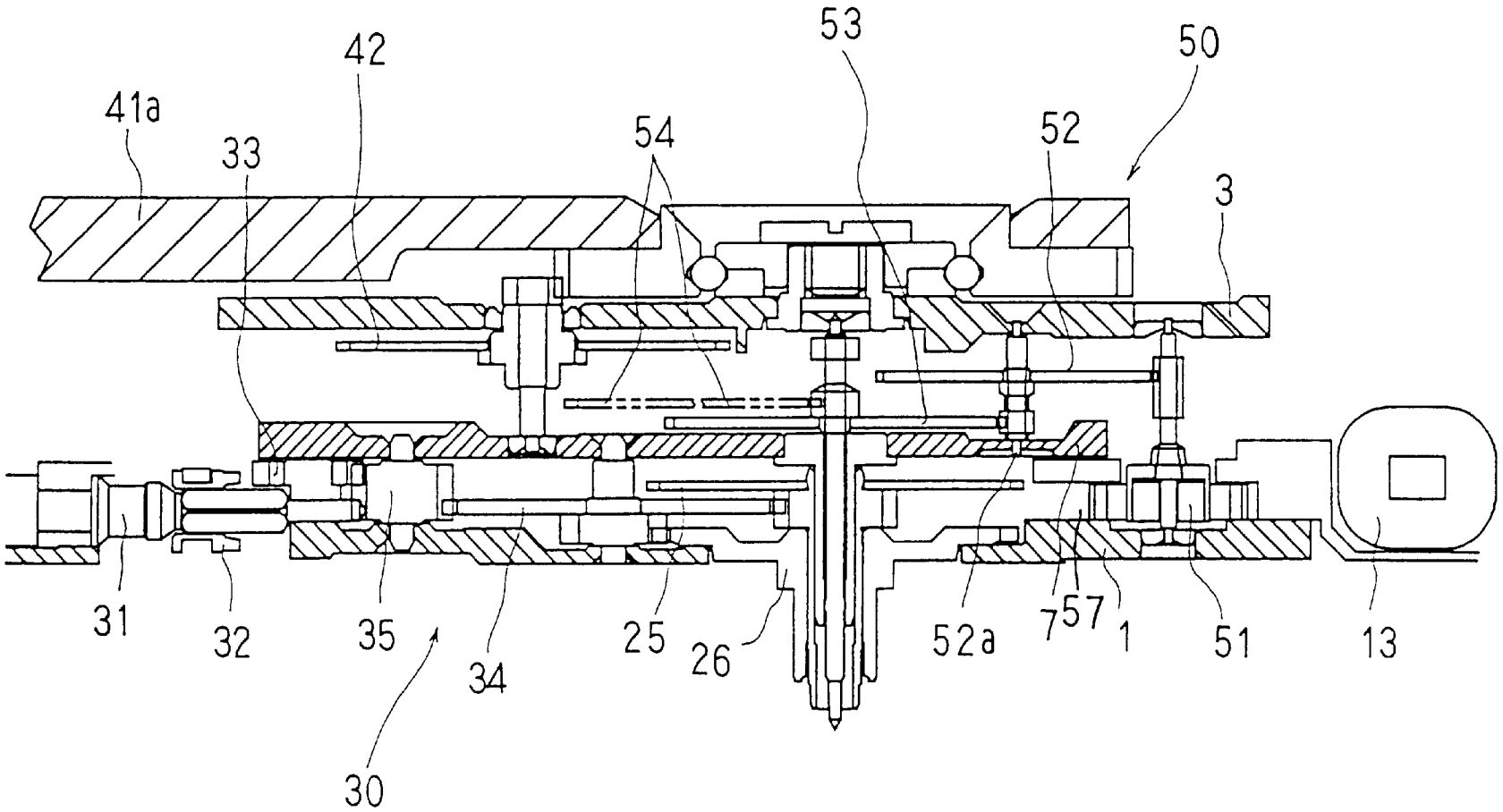
FIG. 7 is an enlarged sectional view of a principal part of the electric power generation watch of the present invention shown in FIG. 1, and it mainly shows a portion including a time correction train wheel and a train wheel for chronograph.

In other words, the time indication train wheel 20 and the time correction train wheel 30 are supported by the ground plate 1 and the intermediate cradle 2 via shafts as shown in FIG. 2(*b*) and FIG. 7. In addition, the chronograph train wheel 50 and an electric power generation intermediate wheel 42 of the electric power generation train wheel 40 are supported by the intermediate cradle 2 and the chronograph cradle 3 via shafts as shown in FIGS. 2(*a*), 7 and 8.

Although not especially illustrated, each of the intermediate cradle 2 and the chronograph cradle 3 is singly screwed to the ground plate 1. The ground plate 1, the intermediate cradle 2, and the chronograph cradle 3 are fixed to the watch case so as to be separated at predetermined intervals.

Owing to such a configuration, in the self-winding electric power generation watch according to the present embodiment, the train wheels for watch, electric power generation, and additional function (chronograph function), and the motors for driving these train wheels can be disposed efficiently within the watch case. It thus becomes possible to provide the self-winding electric power generation watch with an additional function other than the time indication function without increasing the size of the watch as a whole. In addition, it becomes possible to make the watch thin though the watch has both the self-winding electric power generation function and the additional function.

Hereafter, components forming the electric power generation watch of the present embodiment will be described in more detail by referring to the drawing.

Arrangement and Structure of Motor

The motor 11 for watch, the electric power generation motor 12, and the motor 13 for chronograph provided as the additional function are two-dimensionally disposed in the watch case respectively by tubes (not illustrated) planted onto the ground plate 1, and fixed by screwing.

Other components which are not especially referred to in the present embodiment are also positioned in the watch case and supported by and fixed to the ground plate 4 by using a similar fixing method or another indirect method.

And in the present embodiment, the watch motor 11, the electric power generation motor 12, and the chronograph motor 13 are disposed along the periphery of the ground plate 1 so as to surround the central part of the watch.

As for the arrangement and structure for disposing motors of three kinds, i.e., the watch motor 11, the electric power generation motor 12, and the chronograph motor 13, it is conceivable to dispose a plurality of motors in a multi-stage form in the height direction. For example, it is conceivable to dispose an electric power generation structure (the electric power generation motor 12 and the electric power generation train wheel 40) for performing the self-winding electric power generation function over the ordinary watch module as it is. If such a multi-stage structure of motors is adopted, however, the entire watch structure becomes thick by thickness values of the motors piled up, resulting in reverse structure against the demand for thinner thickness in recent years.

In view of this, if the motors are disposed along the periphery of the ground plate 1, such a structure that movement of a toothed wheel is transmitted from each of the watch motor 11 and the chronograph motor 13 toward the center of the watch by each train wheel must be adopted in order to conduct the ordinary time indication and the chronograph indication in the central part of the watch. In this case, however, it becomes possible to dispose the motors so as to keep them apart from each other. This structure is rather desirable in that the motors do not exert a bad magnetic influence upon each other.

In the present embodiment, the watch motor 1, the electric power generation motor 12, and the chronograph motor 13 are formed of bar shaped coils 11*a*, 12*a* and 13*a*, respectively. In addition, each of the bar shaped coils 11*a*, 12*a* and 13*a* (and their extension lines) is disposed near the periphery of the ground plate 1 so as to nearly form one side of a triangle shown in FIG. 1. The bar shaped coils 11*a*, 12*a* and 13*a* are two-dimensionally arranged so that they surround the ground plate 1.

Furthermore, the bar shaped coils 11*a*, 12*a* and 13*a* thus two-dimensionally arranged in the triangular form are formed so as to have nearly the same height as shown in FIGS. 2(*a*) and 2(*b*). The watch motor 11, the electric power generation motor 12, and the chronograph motor 13 have to nearly the same heights in the watch case, and stators 38, 44 and 57, respectively, which are located near a center of the watch relative to the respective bar shaped coils 11*a*, 12*a* and 13*a*.

Furthermore, as shown in FIG. 1, hand setting components 36 for controlling the operation of a stem 31 described later is disposed in a region linking ends of the watch motor 11 and the electric power generation motor 12. In a region linking ends of the watch motor 11 and the chronograph motor 13, the storage battery 14 is disposed.

By the way, the electric power generation motor 12 and the storage battery 14 are large in two-dimensional size. From the aspect of the electric power generation efficiency and charging efficiency, therefore, the electric power generation motor 13 and the storage battery 14 are disposed not adjacent to each other but across the watch center from each other.

On the ground plate in a region 1 surrounded by the bar shaped coils 11*a*, 12*a* and 13*a* respectively of the watch motor 11, the electric power generation motor 12 and the chronograph motor 13, the storage battery 14, and the hand setting components 36, train wheels driven by the watch motor 11 and the chronograph motor 13 are disposed. Respective train wheels transmit toothed wheel operation for time indication and toothed wheel operation for chronograph, from respective motors disposed along the periphery of the ground plate 1 toward the central part of the watch.

Although details will be described later, the watch train wheels 20 and 30 for time indication, the train wheel 40 for electric power generation, and the train wheel 50 for chronograph are supported via shafts in a two layer form by the ground plate 1, the intermediate cradle 2, and the chronograph cradle 3. The train wheels of the three kinds are adapted so as to interfere with each other.

By thus arranging three bar shaped motors nearly in a triangular form and adopting such an arrangement structure of components as to make the most of the triangular arrangement configuration, it becomes possible to implement an optimum arrangement structure of components of the watch without increasing the area in the watch case to the utmost.

Furthermore, by thus arranging the three motors on the same plane, height values of the motors in the watch thickness direction can be set equal to nearly the same value. In addition, by arranging the train wheels in a region on the same plane surrounded by the motors, height values of the train wheels in the watch thickness direction can also be made nearly equal to the height values of the surrounding motors. Therefore, it becomes possible to incorporate the multi-function structure performing the electric power generation function and the chronograph function in the thickness of the existing watch structure. The thickness of the watch as a whole does not increase.

Train Wheels for Watch (Time Display Train Wheel and Time Correction Train Wheel)

Figure 3:
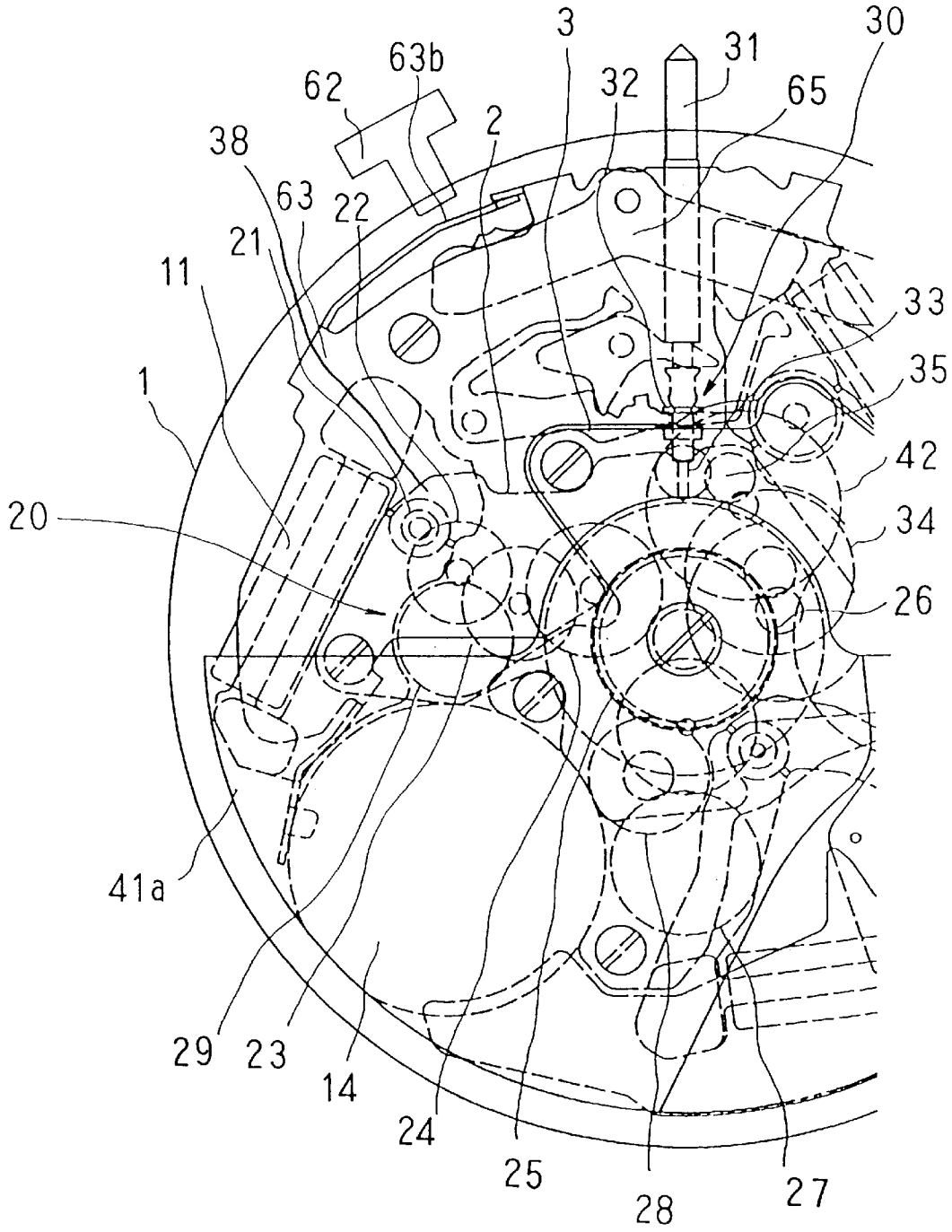
FIG. 3 is an enlarged plan view of a principal part of the electric power generation watch of the present invention shown in FIG. 1, and it mainly shows a half of six o'clock side of the watch.
Figure 5:
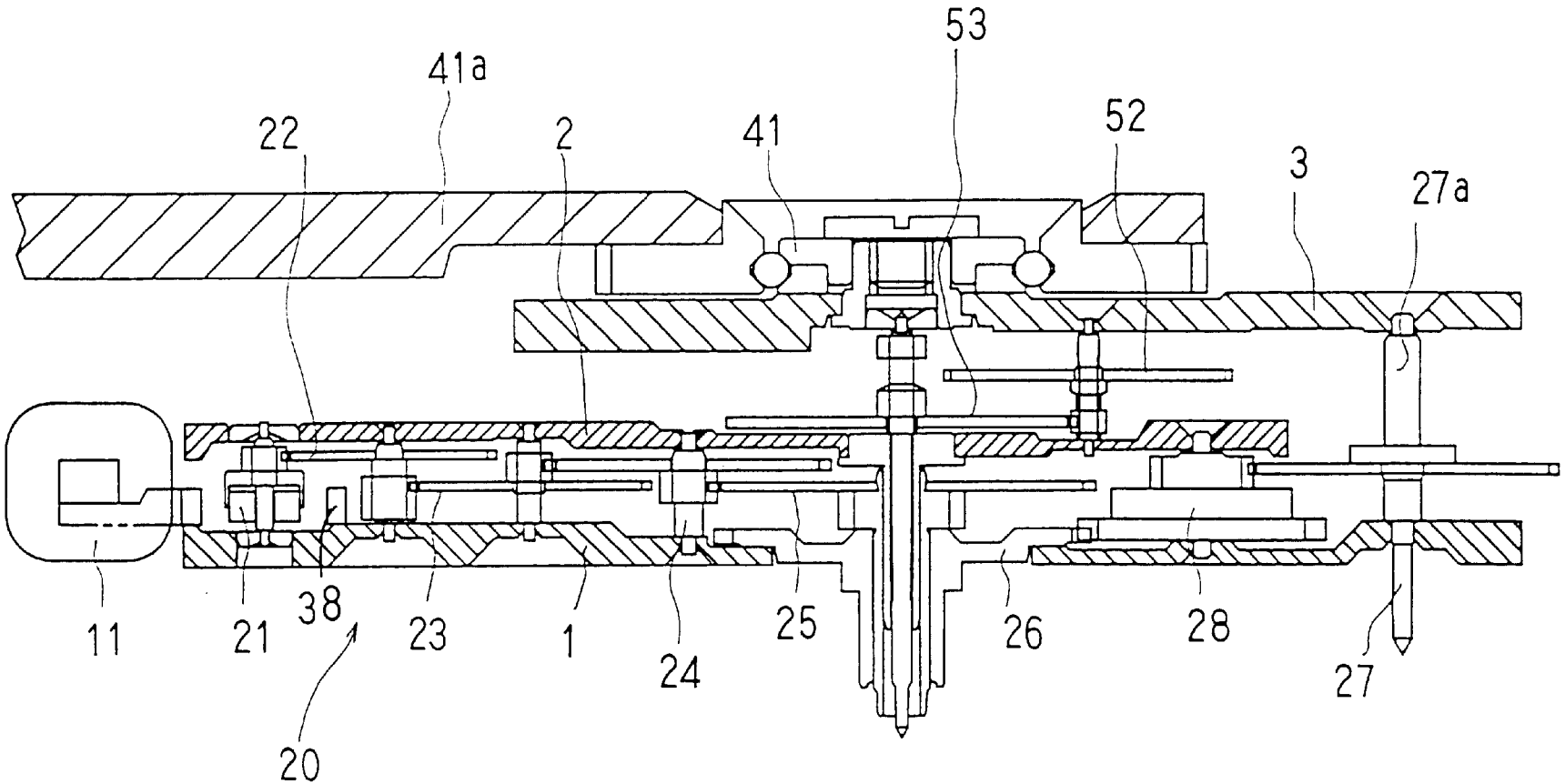
FIG. 5 is an enlarged sectional view of a principal part of the electric power generation watch of the present invention shown in FIG. 1, and it mainly shows a time indication train wheel portion.

In the time indication train wheel 20 for indicating the ordinary time, a rotor 21 driven by the watch motor 11, a fifth wheel 22, a fourth wheel 23, a third wheel 24, and a center wheel 25 are successively engaged as shown in FIGS. 3 and 5.

The center wheel 25 is disposed nearly in the center of the watch. By this center wheel 25, a minute hand which is not illustrated is driven to indicate minute .

Shafts of the rotor 21, the fifth wheel 22, the fourth wheel 23, the third wheel 24, and the center wheel 25 are supported by the ground plate 1 and the intermediate cradle 2 as shown in FIG. 5.

Figure 6:
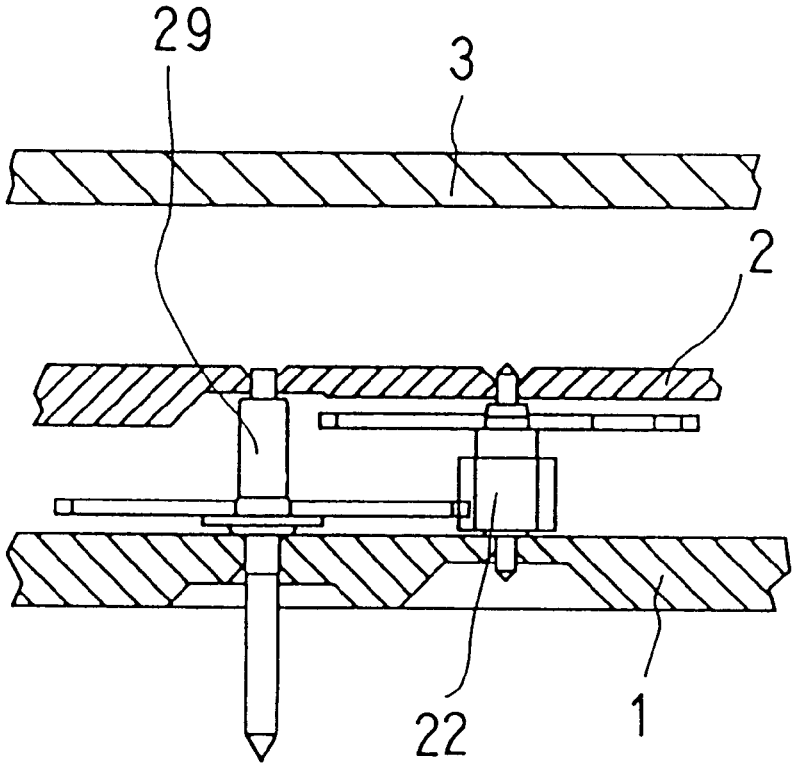
FIG. 6 is an enlarged sectional view of a principal part of the electric power generation watch of the present invention shown in FIG. 1, and it mainly shows a second wheel portion of the train wheel for watch.

As shown in FIGS. 3 and 6, the fifth wheel 22 is engaged with a second wheel 29 in a system different from the fourth wheel 23. As shown in FIG. 3, the second wheel 29 is disposed in a six o'clock position (on the left side of FIG. 3) deviated from the watch center. A second hand is driven by this second wheel 29 to conduct second indication. As shown in FIG. 6, this second wheel 29 is also supported by the ground plate 1 and the intermediate cradle 2 via shafts.

As shown in FIG. 5, a cylindrical wheel 26 is disposed under the center wheel 25 (on the ground plate side) as if the center wheel 25 has been piled above the cylindrical wheel 26. An hour hand for indicating the hour of the ordinary time is attached to the cylindrical wheel 26.

Furthermore, rotation is transmitted from the cylindrical wheel 26 to a hand wheel 27 for conducting 24-hour indication via a hand intermediate wheel 28. As shown in FIG. 3, the hand wheel 27 is disposed in a nine o'clock position (on a bottom side of FIG. 3) deviated from the watch center. A hand for 24-hour indication which is not illustrated is attached to the hand wheel 27.

As shown in FIG. 5, the cylindrical wheel 26 and the hand intermediate wheel 28 are supported by the ground plate 1 and the intermediate cradle 2 via shafts. As for the hand wheel 27, the bottom side (ground plate side) of its shaft is supported by the ground plate 1, and a top side shaft 27*a* is supported by a chronograph cradle 3 described later as shown in FIG. 5.

The time indication train wheel having such a configuration is driven by the watch motor 11 supplied with electric power from the storage battery 14 described later. The time display train wheel thus conducts indication of the ordinary time.

First of all, the rotor 21 serving as a rotor of the watch motor 11 is reduced in speed by the watch motor 11. The fifth wheel 22, the fourth wheel 23, and the third wheel 24 which serve as speed reduction wheels of the watch train wheel are driven. Then, the center wheel 25 engaging with the third wheel 24 is rotated, and the minute hand which is not illustrated is driven to indicate the minute of the ordinary time.

As for hour indication of the ordinary time, it is conducted by the cylindrical wheel 26 having the hour hand attached thereto which is driven and reduced in speed by a minute wheel 34 (see FIG. 7) engaging with the center wheel 25.

As for second indication of the ordinary time, it is conducted by the second wheel 29 reduced in speed by the fifth wheel 22.

Furthermore, the hand wheel 27 is reduced to half in speed by transmitting rotation from the cylindrical wheel 26 via the hand intermediate wheel 28, and 24-hour indication is conducted by the hand wheel 27.

As shown in FIGS. 3 and 7, the time correction train wheel 30 for correcting the time includes the stem 31 serving as an external manipulation member projected from a three o'clock position (top side of FIG. 3) to outside of the watch case, and an enveloping wheel 32, an iron pinion 33, a minute intermediate wheel 35, and the minute wheel 34 which successively engage with the stem 31.

As shown in FIG. 7, the cylindrical wheel 26 is driven and reduced in speed by the minute wheel 34 engaging with the center wheel 25 of the time indication train wheel 20. By manipulating the stem 31 from the outside of the watch, rotation is transmitted from the minute intermediate wheel 35 to the minute wheel 34, and consequently the hour and minute are corrected.

As shown in FIG. 7, the enveloping wheel 32, the iron pinion 33, the minute intermediate wheel 35, and the minute wheel 34 included in the time correction train wheel 30 are disposed between the ground plate 1 and the intermediate cradle 2, and shafts of them are supported between the ground plate 1 and the intermediate cradle 2.

Except the top side shaft 27*a* of the hand wheel 27 (see FIG. 5), all of the time indication train wheel 20 for indicating the second, minute, hour, and 24-hour of the ordinary time, and the time correction train wheel 30 for correcting the time are thus arranged under the intermediate cradle 2 (on the ground plate 1 side). It thus becomes possible to arrange other function train wheels above the intermediate cradle 2 in the condition that they are piled above the time indication train wheel 20 and the time correction train wheel 30. To be concrete, a part of the electric power generation train wheel 40 described later and the chronograph train wheel for performing an additional function are disposed so as to be piled above the watch train wheels 20, 30.

Electric Power Generation Train Wheel

Figure 4:
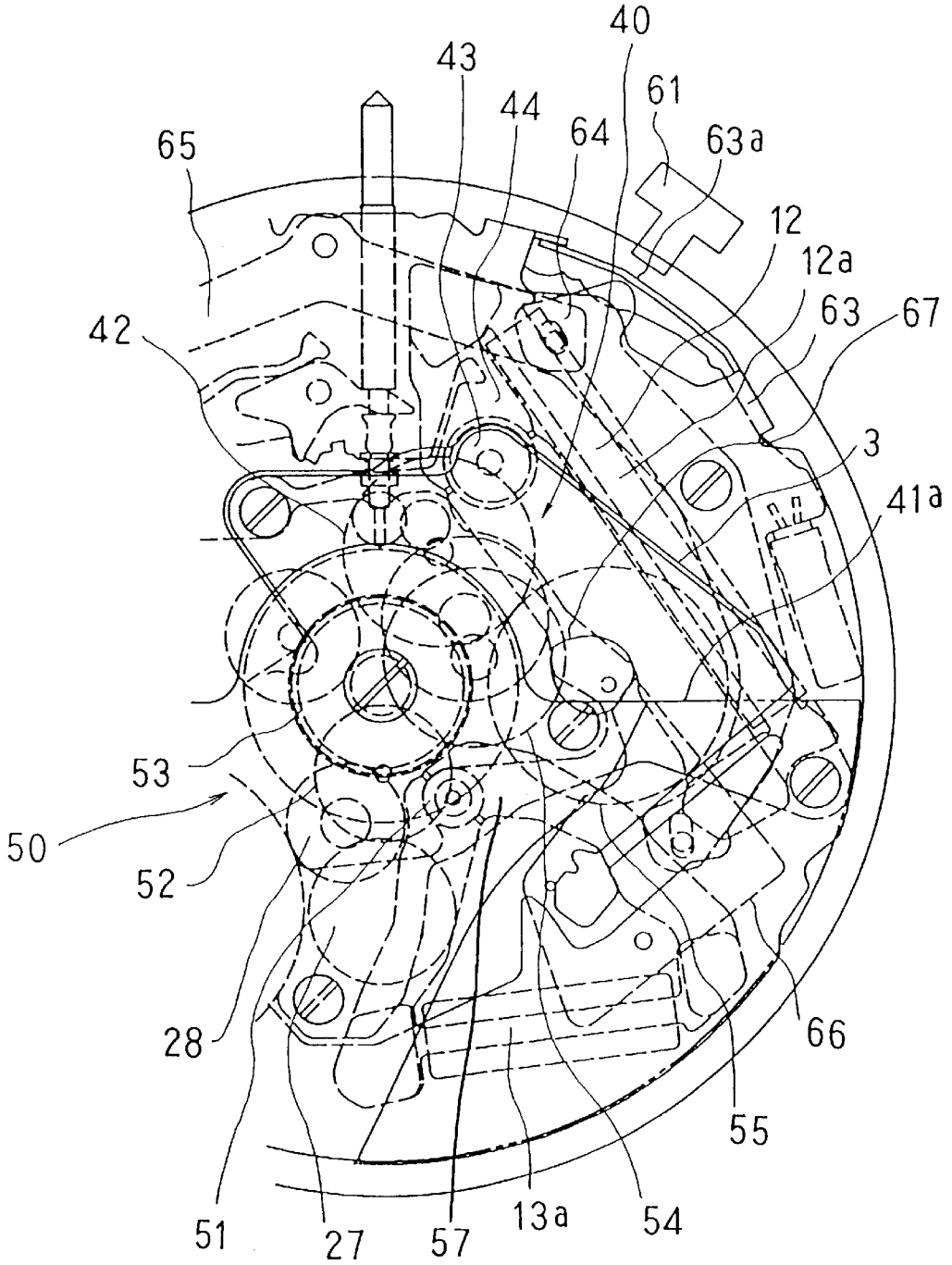
FIG. 4 is an enlarged plan view of a principal part of the electric power generation watch of the present invention shown in FIG. 1, and it mainly shows a half of twelve o'clock side of the watch.
Figure 8:
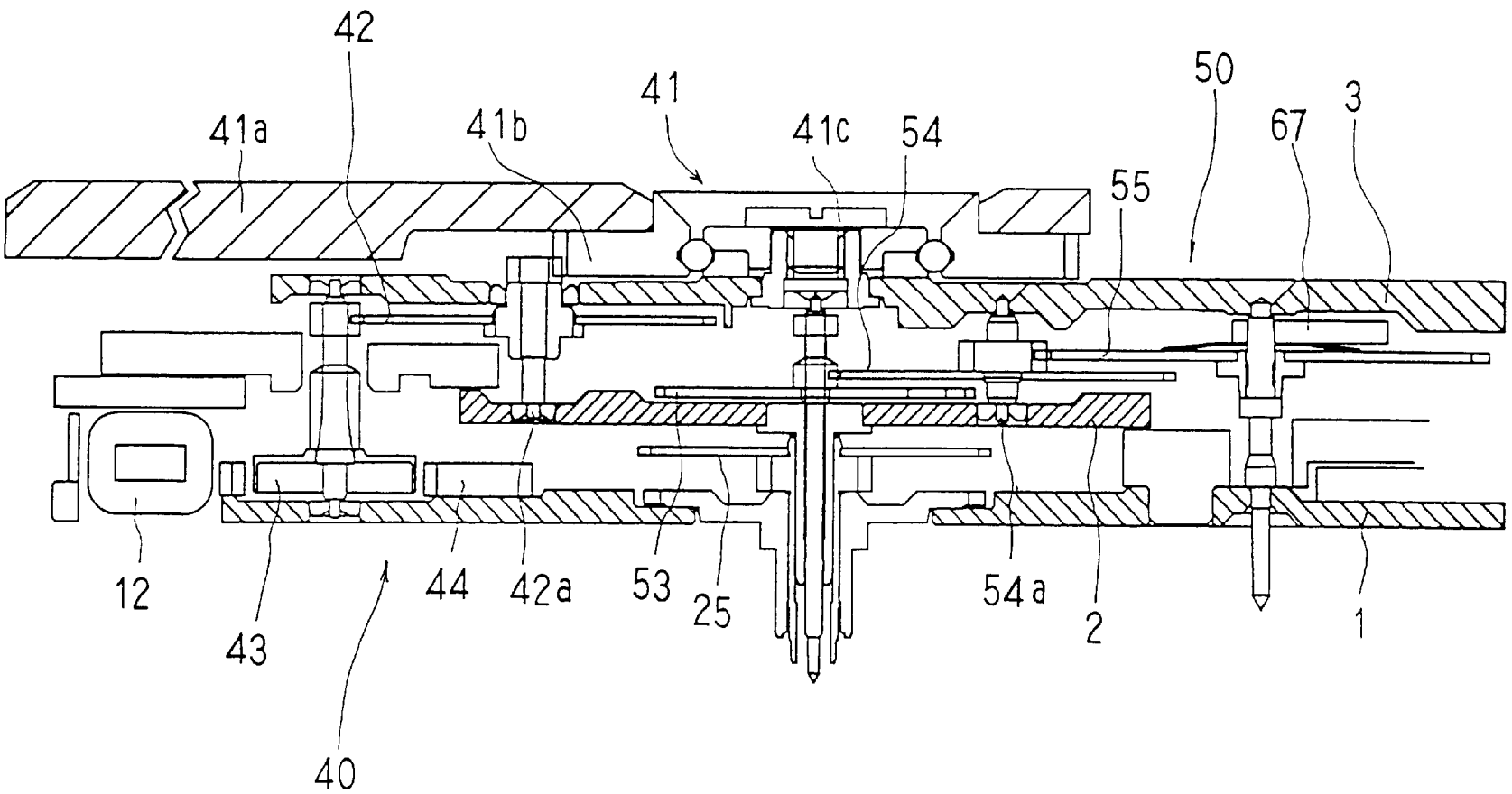
FIG. 8 is an enlarged sectional view of a principal part of the electric power generation watch of the present invention shown in FIG. 1, and it mainly shows a portion including a train wheel for electric power generation and a train wheel for chronograph.

As shown in FIGS. 4 and 8, the electric power generation train wheel 40 and the electric power generation motor 12 functioning as a generator for converting kinetic energy of the rotary weight rotated by operation during carrying to electric energy include a rotary weight block 41, an electric power generation intermediate wheel 42, an electric power generation motor 43, an electric power generation stator 44, and the electric power generation motor 12 (the bar shaped coil 12*a*).

The rotary weight block 41 includes a self rotating rotary weight 41*a* and a weight cannon 41*b* rotating with the rotary weight 41*a* as one body. The rotary weight block 41 is fixed to the chronograph cradle 3 by a weight set screw 41*c* so that the rotary weight 41*a* may be rotatable. In this embodiment, the chronograph cradle 3 serves also as a weight support cradle for supporting the rotary weight block 41. The rotation of the rotary weight block 41 is transmitted to the electric power generation rotor 43 via the electric power generation intermediate wheel 42.

The electric power generation intermediate wheel 42 forms a speed increasing train wheel, and increases the speed of rotation of the rotary weight 41*a*, transmits it to the electric power generation rotor 43, and rotates the electric power generation rotor 43 at a high speed. As shown in FIG. 8, this electric power generation intermediate wheel 42 is disposed between the intermediate cradle 2 and the chronograph cradle 3. In other words, a bottom shaft portion 42*a* of the electric power generation intermediate wheel 42 is supported by the intermediate cradle 2. As a result, the present embodiment has such a structure that the electric power generation intermediate wheel 42 is piled nearly above the watch train wheels (the time indication train wheel 20 and the time correction train wheel 30) disposed under the intermediate cradle 2 (on the ground plate side) (see FIGS. 5 and 7).

The electric power generation rotor 43 serving as the rotor of the electric power generation motor 12 (generator) is placed above the ground plate 1. The electric power generation rotor 43 is supported by the ground plate 1 and the chronograph cradle 3 via shafts.

The electric power generation train wheel 40 thus forming a part of the generator converts kinetic energy generated by operation of a user wearing the watch of the present invention to electric energy, and causes charging voltage to be outputted from the electric power generation coil 12. And this charging voltage charges the storage battery (secondary power supply) 14 via a composite circuit (not illustrated) having a charging circuit. This charged energy is used as power supply of a watch circuit including the watch motor 11 and the chronograph motor 13 and the like.

Chronograph Train Wheel

As shown in FIGS. 4 and 7, the chronograph train wheel 50 for conducting chronograph indication as an additional function includes a second chronograph rotor 51 serving as a rotor of the chronograph motor 13, a second chronograph wheel 53 for indicating the second of the chronograph time which is driven via a second chronograph intermediate wheel 52, and a minute chronograph wheel 55 for indicating the minute of the chronograph time which is driven via a minute chronograph intermediate wheel 54.

Top portions of shafts of the chronograph train wheel 50 are supported by the chronograph cradle 3.

In the same way as the above described intermediate cradle 2, the chronograph cradle 3 is screwed to the ground plate 1 and thereby fixed to the watch case.

The second chronograph motor 51 is reduced in speed by the chronograph motor 13. The second chronograph wheel 53 disposed in the center of the watch is driven by the second chronograph motor 51 via the second chronograph intermediate wheel 52. By the second chronograph wheel 53, the second of the chronograph time is indicated.

In the present embodiment, the second chronograph rotor 51 is supported by the ground plate 1 and the chronograph cradle 3 via shafts, and the second chronograph Intermediate wheel 52 is supported by the intermediate cradle 2 and the chronograph cradle 3 via shafts as shown in FIG. 7.

In the present embodiment, the second wheel 29 of the time indication train wheel 20 having the second hand attached thereto is disposed under the intermediate cradle 2 in the six o'clock position deviated from the watch center as described earlier. Therefore, the second chronograph wheel 53 of the chronograph train wheel 50 is disposed above the intermediate cradle 2 in the watch center position.

In the present embodiment, therefore, a bottom portion 52*a* of the shaft of the second chronograph intermediate wheel 52 is supported by the intermediate cradle 2. This results in such an arrangement structure that the second chronograph intermediate wheel 52 two-dimensionally overlaps the hand intermediate wheel 28 of the time indication train wheel 20 disposed under the intermediate cradle 2 (on the ground plate side) as shown in FIG. 5.

The minute chronograph wheel 55 is disposed in twelve o'clock position, and driven by the second chronograph wheel 53 via the minute chronograph intermediate wheel 54 (see FIGS. 4 and 8). The minute of the chronograph time is indicated by this minute chronograph wheel 55. As shown in FIG. 8, a heart cam 67 is attached to the minute chronograph wheel 55 integrally therewith. The heart cam 67 is driven by a chronograph manipulation means described later to conduct start/stop and reset manipulation of the chronograph function (see FIG. 9).

As shown in FIG. 8, the minute chronograph wheel 55 is placed above the ground plate 1, and its shaft is supported by the ground plate 1 and the chronograph cradle 3. The rotation of the above described second chronograph wheel 53 is transmitted to the minute chronograph wheel 55 via the minute chronograph intermediate wheel 54 having a shaft supported by the intermediate cradle 2 and the chronograph cradle 3.

In other words, in the present embodiment, a bottom portion 54*a* of the minute chronograph intermediate wheel 54 is supported by the intermediate cradle 2 via shafts. This results in such an arrangement that the minute chronograph intermediate wheel 54 two-dimensionally overlaps the minute wheel 34 of the time correction train wheel 30 disposed under the intermediate cradle 2 (on the ground plate side) (see FIG. 7).

In the present embodiment, the minute chronograph wheel 55 is supported by the ground plate 1 and the chronograph cradle 3 via shafts. As a result, a bearing interval of the minute chronograph wheel 55 can be made as large as possible. Therefore, it becomes possible to make the deflection of a hand (not illustrated) attached to the minute chronograph wheel 55. Accordingly, rubbing and the like of the hand can be prevented.

Chronograph Manipulation Means

Figure 9:
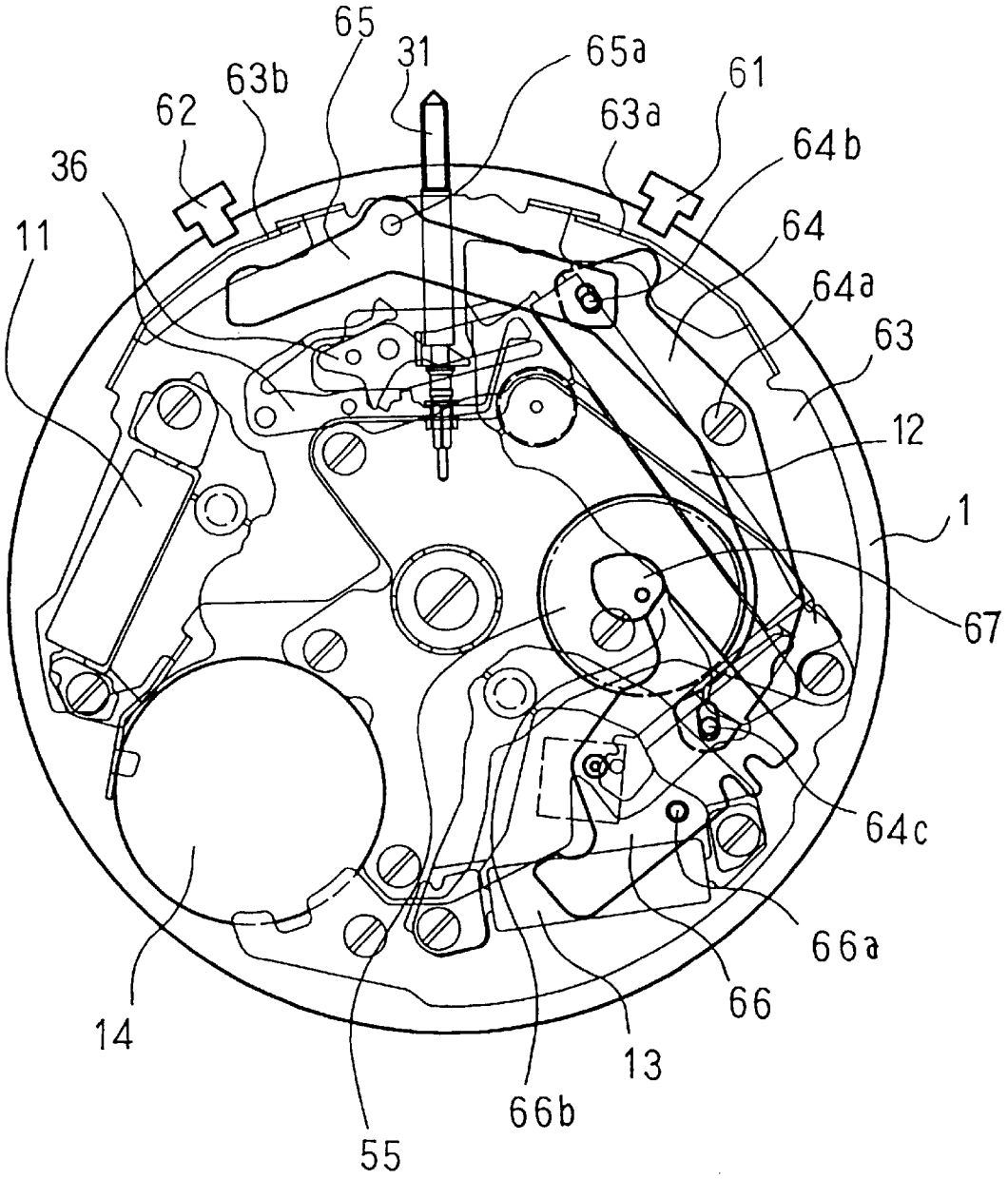
FIG. 9 is a schematic overall plan view schematically showing a chronograph manipulation means of the electric power generation watch of the present invention shown in FIG. 1.

As shown in FIG. 9, chronograph manipulation means for manipulating and setting the above described chronograph train wheel 50 includes a start/stop button 61 disposed in a two o'clock position of the watch case (not illustrated), and a reset button 62 disposed in a four o'clock position of the watch. The chronograph manipulation means further includes a switch plate 63, a start/stop lever 64, a hand return lever 65, and a hand return transmission lever 66, which are pressed and operated by the start/stop button 61 and the reset button 62.

The switch plate 63 has a first switch portion 63*a* pressed by the start/stop button 61 and a second switch portion 63*b* pressed by the reset button 62. When the first or second switch portion 63*a* or 63*b* is pressed, the start/stop lever 64 or the hand return lever 65 is actuated to implement the start, stop, or reset manipulation of the chronograph function.

If the start/stop button 61 is pressed, then the start/stop lever 64 is pressed via the first switch portion 63*a* of the switch plate 63, and the start/stop lever 64 rotates around a lever rotation center 64*a* in the counterclockwise direction in FIG. 9.

On ends of the start/stop lever 64, axial joint portions 64*b* and 64*c* are projected. Hole portions of the hand return lever 65 and the hand return transmission lever 66 are jointed to the joint portions 64*b* and 64*c*, respectively. If the start/stop lever 64 rotates in the counterclockwise direction of FIG. 9, therefore, the turning force is transmitted to the hand return transmission lever 66, and the hand return transmission lever 66 rotates around a lever rotation center 66*a* in the clockwise direction in FIG. 9.

In the hand return transmission lever 66, a heart cam restraining portion 66*b* is provided. By this heart cam restraining portion 66*b*, a heart cam 67 (see FIG. 8) attached to the above described minute chronograph wheel 55 is restrained. If the hand return transmission lever 66 is actuated by the start/stop lever 64, therefore, restraint of the minute chronograph wheel 55 having the heart cam 67 attached thereto is canceled, and the chronograph function becomes ready to operate.

If the start/stop button 61 is pressed simultaneously therewith, then the first switch portion 63*a* of the switch plate 63 comes in contact with a switch pattern (not illustrated), and an electric switch is turned on. As a result, the chronograph function is actuated.

On the other hand, if the reset button is pressed, then the hand return lever 65 is pressed via the second switch portion 63*b* of the switch plate 63, and the hand return lever 65 rotates around a lever rotation center 65*a* in the counterclockwise direction of FIG. 9.

The hand return lever 65 is jointed to an axial joint portion 64*b* provided on one end of the start/stop lever 64. If the hand return lever 65 rotates, therefore, then the turning force is transmitted to the start/stop lever 64, and the start/stop lever 64 rotates around the rotation center 64*a* in the clockwise direction of FIG. 9. Since the hole portion of the hand return transmission lever 66 is jointed to the joint portion 64*c* provided on the other end of the start/stop lever 64, the turning force of the start/stop lever 64 is transmitted to the hand return transmission lever 66, and the hand return transmission lever 66 rotates around the rotation center 66*a* in the counterclockwise direction of FIG. 9.

As a result, the heart cam 67 is restrained by the heart cam restraining portion 66*b* of the hand return transmission lever 66. Accordingly, the chronograph hand (not illustrated) attached to the heart cam 67 and the minute chronograph wheel 55 integrally therewith is returned to a zero indication position (reset position).

Figure 11:
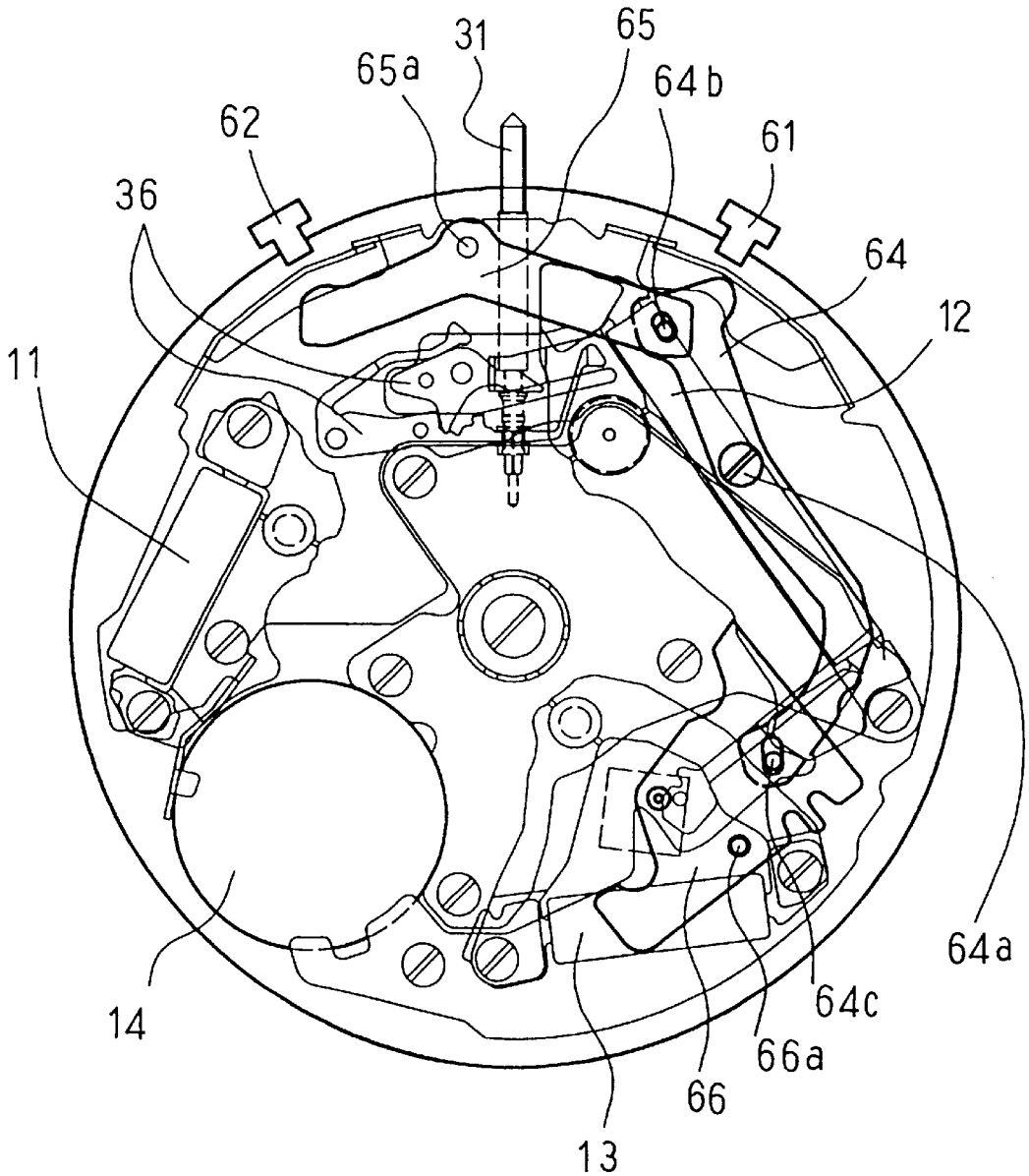
FIG. 11 is a schematic overall plan view schematically showing another form of a chronograph manipulation means of the electric power generation watch of the present invention shown in FIG. 1.

In the present embodiment, three chronograph levers (the start/stop lever 64, the hand return lever 65, and the hand return transmission lever 66) are disposed in piles so as to cover the electric power generation motor 12 as shown in FIG. 9 or 11.

Figure 10:
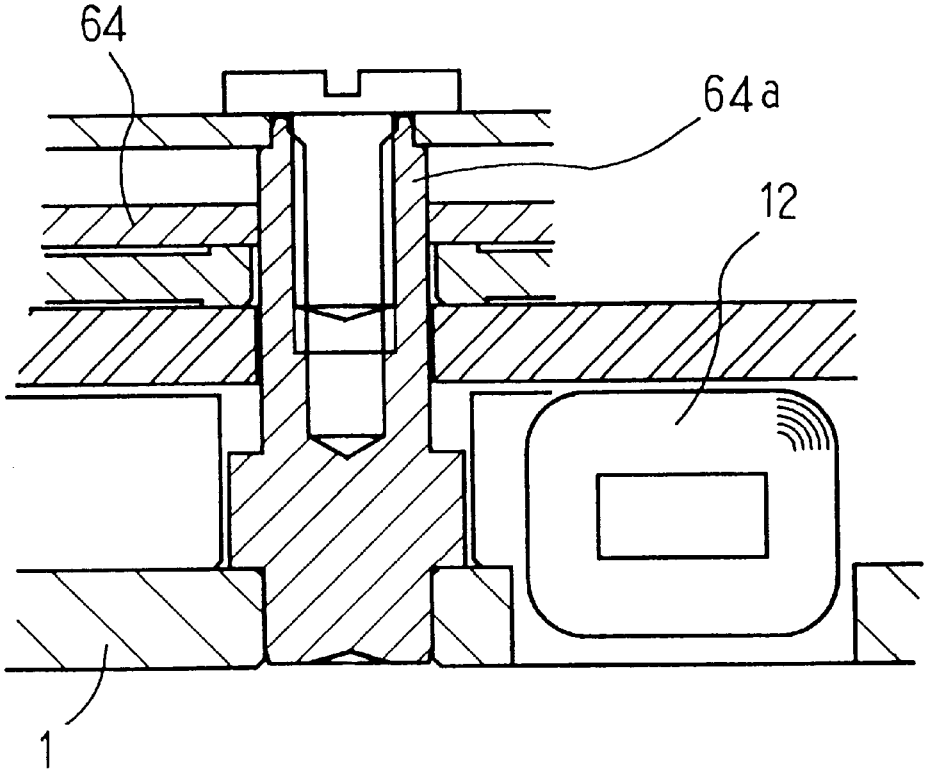
FIG. 10 is an enlarged sectional view of a principal part schematically showing a support structure of a chronograph lever shown in FIG. 9.

As for a structure for supporting the chronograph levers, an example is shown in FIG. 10. In the structure shown in FIG. 10 (corresponding to FIG. 9), the lever rotation center 64*a* of the start/stop lever 64 is planted in the ground plate 1 to support the chronograph levers. In this case, the two-dimensional position of the electric power generation motor 12 does not overlap the lever rotation center 64*a* of the start/stop lever 64 (see FIG. 9).

Figure 12:
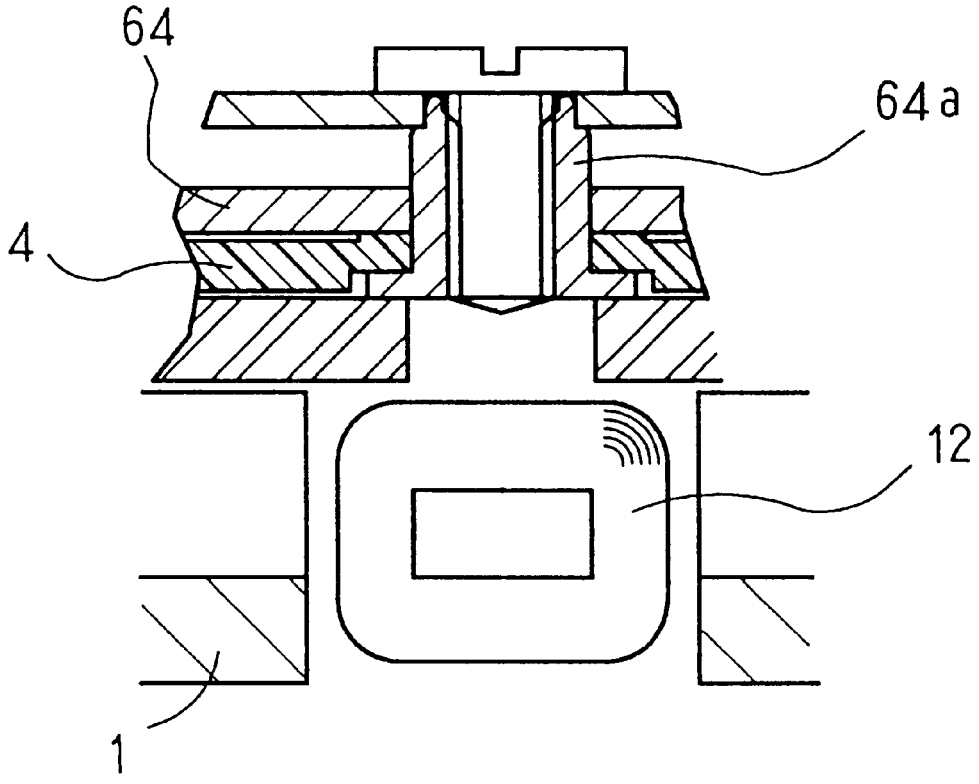
FIG. 12 is an enlarged sectional view of a principal part schematically showing a support structure of a chronograph lever shown in FIG. 11.

Furthermore, as in a structure shown in FIG. 12 (corresponding to FIG. 11), the lever rotation center 64*a* of the start/stop lever 64 may be disposed so as to overlap the two-dimensional position of the electric power generation motor 12. In this case, a chronograph lever support base 4 made of resin or the like is disposed above the electric power generation motor 12 (across the electric power generation motor 12 from the ground plate 1), and the lever rotation center 64*a* of the start/stop lever 64 is planted in the support base 4 as shown in FIG. 12. As a result, the electric power generation motor 12 and the lever rotation center 64*a* can be disposed so as to overlap each other. By adopting such a structure, it becomes unnecessary to deviate the two-dimensional position of the lever rotation center 64*a* from the electric power generation motor 12.

By virtue of the structure heretofore described, the start/stop lever 64, the hand return lever 65, and the electric power generation motor 12 are disposed so as to partly overlap each other in the watch thickness direction. Even if both the electric power generation motor 12 and the chronograph lever are provided, therefore, the structure of both functions can be arranged efficiently in the watch case without requiring an extra two-dimensional space.

When using the chronograph function by using the above described chronograph manipulation means, the start/stop button 61 is first pressed. As a result, the start/stop lever 64 is actuated via the first switch portion 63*a* of the switch plate 63. Upon actuation of the start/stop lever 64, the hand return transmission lever 66 jointed to the start/stop lever 64 is actuated. Since the restraint of the minute chronograph wheel 55 having the heart cam 67 attached thereto is thus canceled, the chronograph function becomes ready to operate. At the same time, the first switch portion 63*a* of the switch plate 63 comes in contact with a switch contact portion of a composite circuit (not illustrated), the chronograph motor 13 starts to drive, and the chronograph is actuated.

The start/stop lever 64 keeps waiting in such a state that it is pressed by the start/stop button 61. By pressing the start/stop button 61 again, only the first switch portion 63*a* of the switch plate 63 operates to turn on the electric switch, and the operation of the chronograph time is stopped.

When returning the chronograph to zero (i.e., resetting the chronograph), the reset button 62 disposed in the four o'clockposition of the watch case (top left of FIG. 9) is pressed. As a result, the hand return lever 65 is actuated via the second switch portion 63*b* of the switch plate 63. Accordingly, the start/stop lever 64 jointed to the hand return lever 65 is returned to its original position. At the same time, the hand return transmission lever 66 is also returned. By the heart cam 56 attached to the minute chronograph wheel 55, the minute chronograph wheel 55 is rotated and returns to zero is effected.

As heretofore described, in the self-winding electric power generation watch according to an embodiment of the present invention, the train wheels for watch, electric power generation, and chronograph function, and the motors for driving these train wheels can be disposed efficiently within the watch case. It thus becomes possible to provide the self-winding electric power generation watch with an additional function other than the time indication function without increasing the size of the watch as a whole. In addition, it becomes possible to make the watch thin though the watch has the additional function.

In other words, in the present embodiment, the electric power generation motor 12, the watch motor 11, the storage battery 14, and the chronograph motor 13 are disposed along the periphery of the ground plate 1 in the watch case so as to surround the central part of the watch. In addition, in the region surrounded by these motors and the storage battery 14, the electric power generation train wheel 40, the watch train wheels 20 and 30, and the chronograph train wheel 50 are disposed.

As a result, a bad influence caused by proximity between motors can be prevented. By utilizing the arrangement configuration of the motors, an efficient arrangement of other components, such as the storage battery 14, the hand setting components 36, and the train wheels, becomes possible. In addition, the height of the motors can be set to nearly the same height. Therefore, it becomes possible to make the watch structure thin. Furthermore, the chronograph lever and the lever rotation center can be disposed so as to two-dimensionally overlap the electric power generation motor. Efficient disposition of the electric power generation motor thus becomes possible.

Furthermore, in the present embodiment, the ground plate 1 disposed on the bottom of the case, the platelike intermediate cradle 2 opposed to the ground plate 1, and the platelike chronograph cradle 3 are provided in the region surrounded by the motors. Shafts of respective train wheels are supported in a two-layer structure by the ground plate 1, the intermediate cradle 2, and the chronograph cradle 3.

The second wheel 29 of the time indication train wheel 20 and the hand wheel 27 of 24-hour indication are disposed so as not to overlap the center position of the watch. In addition, the watch train wheels 20 and 30 are two-dimensionally dispersed and disposed under the intermediate cradle 2. In addition, the second chronograph wheel 53 located in the watch center of the chronograph train wheel 50, the second chronograph intermediate wheel 54, the minute chronograph intermediate wheel 54 for transmitting the rotation of the second chronograph wheel 53 to the minute chronograph wheel 55, and the electric power generation intermediate wheel 42 for transmitting the rotation of the rotary weight 41*a* of the electric power generation train wheel 40 to the electric power generation rotor 43 are disposed above the intermediate cradle 2. As a result, the time indication train wheel 20, the time correction train wheel 30, the chronograph train wheel 50, and the electric power generation train wheel 40 can be two-dimensionally arranged without restricting each other.

Furthermore, by providing the chronograph cradle, the rotary weight block 41 can be supported above the chronograph cradle 3. The chronograph cradle 3 can also be used as the weight support cradle. The number of cradles is thus minimized. Accordingly, the cost of the watch movement can be lowered.

In this way, the train wheels can be arranged efficiently in the periphery of the center part of the watch surrounded by the motors. In addition, size reduction of the watch movement can be realized.

Industrial Applicability

As heretofore described, the self-winding electric power generation watch according to the present invention is useful as an electronic wrist watch which converts mechanical energy obtained from the rotary weight to electric energy and use it as driving electric power of the wrist watch, and as the wrist watch having an additional function other than the ordinary time indication function. In particular, the self-winding electric power generation watch according to the present invention is suitable to the case where the self-winding electric power generation watch is provided with a chronograph mechanism as the additional function.

What is claimed is:

1. A self-winding electric power generation watch with additional function, comprising:

a ground plate with a periphery, a rotary weight rotationally disposed above the ground plate, an electric power generation motor for generating electric power by rotation of the rotary weight and having a bar shaped coil, an electric power generation train wheel connected between the rotary weight and the electric power generation motor for transmitting a rotation movement of the rotary weight to the electric power generation motor, a watch motor and a watch train wheel for time indication driven by the watch motor, said watch motor being driven by the electric power generated by the electric power generation motor and having a bar shaped coil, a storage battery for storing the electric power generated by the electric power generation motor, and an additional function motor and an additional function train wheel driven by the additional function motor actuated by the electric power generated by the electric power generation motor to provide an addition indication other than time, said additional function motor having a bar shaped coil, wherein in order to obtain a space for disposing the train wheels as much as possible at a center area, said bar shaped coils of the electric power generation motor, watch motor and additional function motor are arranged to surround the center area of the watch so that elongated side portions of the bar shaped coils of the three motors are arranged along the periphery of the ground plate, said electric power generation train wheel, watch train wheel and additional function train wheel being located in an area surrounded by the bar shaped coils.

2. A self-winding electric power generation watch with additional function according to claim 1, wherein said electric power generation train wheel, watch train wheel and additional function train wheel are located in an area surrounded by the bar shaped coils of the three motors and the storage battery.

3. A self-winding electric power generation watch with additional function according to claim 1, wherein each of said bar shaped coils of the three motors have two ends, said two ends of the bar shaped coils of the three motors being located near the periphery of the ground plate.

4. A self-winding electric power generation watch with additional function according to claim 1, wherein said bar shaped coils of the three motors are disposed nearly in a triangular form to surround the center area of the watch.

5. A self-winding electric power generation watch with additional function according to claim 1, wherein said electric power generation motor, watch motor and additional function motor include stators, respectively, said stators of the three motors being located at a center side of the watch relative to the respective bar shaped coils.

6. A self-winding electric power generation watch with additional function according to claim 1, wherein said watch motor, said electric power generation motor, and said additional function motor are disposed nearly to same heights in a watch case.

7. A self-winding electric power generation watch with additional function according to claim 1, wherein in case where said self-winding electric power generation watch comprises an external manipulation member for adjusting said watch train wheel from outside of the watch, and hand setting members for controlling operation of said external manipulation member, each of said hand setting members and said storage battery being disposed so as to be located between said motors and so as to surround a watch center part.

8. A self-winding electric power generation watch with additional function according to claim 1, further comprising a lever member for controlling the additional function train wheel, said lever member being disposed in such a position as to two-dimensionally overlap said electric power generation motor.

9. A self-winding electric power generation watch with additional function according to claim 8, wherein in case where said self-winding electric power generation watch with additional function comprises a watch component for two-dimensionally covering said electric power generation motor and said lever member is held by said watch component, said watch component has a shaft portion serving as a rotation center of said lever member in such a position as to two-dimensionally overlap said electric power generation motor.

10. A self-winding electric power generation watch with additional function, comprising:

a rotary weight rotationally situated inside the watch, an electric power generation motor with a bar shaped coil for generating electric power and an electric power generation train wheel connected between the rotary weight and the electric power generation motor for transmitting a rotation movement of the rotary weight to the electric power generation motor, a watch motor with a bar shaped coil and a watch train wheel for time indication driven by the watch motor, said watch motor being driven by the electric power generated by the electric power generation motor, a storage battery for storing the electric power generated by the electric power generation motor, an additional function motor with a bar shaped coil and are additional function train wheel driven by the additional function motor actuated by the electric power generated by the electric power generation motor to provide an additional indication other than time, a ground plate for supporting at least wheels of the electric power generation train wheel, a cradle in a plate form situated between the ground plate and the rotary weight for rotationally supporting at least one wheel for forming the watch train wheel, additional function train wheel and electric power generation train wheel, said rotary weight being rotationally supported by the cradle, wherein said watch train wheel, electric power generation train wheel and additional function train wheel are situated inside an area surrounded by the bar shaped coils of the three motors; and said electric power generation train wheel includes a wheel supported at a rotary weight side of the cradle and enaging a wheel of the rotary weight, and a wheel supported at a ground plate side of the cradle and engaging a rotor of the electric power generation motor.

11. A self-winding electric power generation watch with additional function according to claim 10, wherein said cradle is formed of an additional function cradle for supporting at least wheels forming the additional function train wheel, and an intermediate cradle for supporting wheels forming the watch train wheel, additional function train wheel, or electric power generation train wheel; said additional function cradle rotationally supports said rotary weight; said additional function cradle and said intermediate cradle are situated between the ground plate and the rotary weight in a form of a layer; and said wheels for forming the watch train wheel, additional function train wheel and electric power generation train wheel are separated and situated between the ground plate and the intermediate cradle, between the intermediate cradle and the additional function cradle, or between the ground plate and the additional function cradle.

12. A self-winding electric power generation watch with additional function according to claim 10, further comprising a lever member for controlling the additional function train wheel, said lever member being disposed in such a position as to two-dimensionally overlap said electric power generation motor.

13. A self-winding electric power generation watch with additional function according to claim 12, further comprising a watch component for two-dimensionally covering said electric power generation motor, said lever member being held by the watch component, said watch component having a shaft portion serving as a rotation center of the lever member in such a position as to two-dimensionally overlap the electric power generation motor.

14. A self-winding electric power generation watch with additional function according to claim 11, wherein said additional function motor and additional function train wheel comprise a chronograph motor and a chronograph train wheel for chronograph indication.

15. A self-winding electric power generation watch with additional function according to claim 1, wherein said additional function motor and said additional function train wheel comprise a chronograph motor and a chronograph train wheel for chronograph indication.

16. A self-winding electric power generation watch with additional function according to claim 11, wherein said additional function cradle comprises a chronograph cradle for supporting said chronograph train wheel via shafts.

17. A self-winding electric power generation watch with additional function according to claim 10, wherein said watch motor, said electric power generation motor, and said additional function motor are disposed nearly to same heights in a watch case.

18. A self-winding electric power generation watch with additional function according to claim 11, wherein said additional function cradle serves as a bearing portion for supporting said rotary weight via shafts.

* * * * *